US007777196B2

(12) United States Patent
Khalil

(10) Patent No.: US 7,777,196 B2
(45) Date of Patent: Aug. 17, 2010

(54) COLD ELECTRON EMITTER DEVICE FOR DISPLAY

(76) Inventor: Wesam Khalil, #102-6990 134th Street, Surrey, BC (CA) V3W 4S9

( * ) Notice: Subject to any disclaimer, the term of this patent is extended or adjusted under 35 U.S.C. 154(b) by 278 days.

(21) Appl. No.: 12/138,369

(22) Filed: Jun. 12, 2008

(65) Prior Publication Data

US 2008/0272310 A1 Nov. 6, 2008

Related U.S. Application Data

(63) Continuation-in-part of application No. 11/152,049, filed on Jun. 15, 2005, now Pat. No. 7,408,173.

(51) Int. Cl.
*H01J 27/24* (2006.01)

(52) U.S. Cl. ..... 250/423 P; 250/370.11; 250/214 R; 250/214 VT; 313/364; 313/365; 313/415; 313/422

(58) Field of Classification Search ..... 250/423, 250/370.11, 214 VT, 200, 549, 207, 214 R, 250/423 P; 378/62, 98.2; 313/364, 365, 313/409, 413, 415, 422
See application file for complete search history.

(56) References Cited

U.S. PATENT DOCUMENTS 4,626,899 A * 12/1986 Tomii et al. ..... 348/796
6,078,643 A * 6/2000 Vogelsong et al. ..... 378/98.2

* cited by examiner

*Primary Examiner*—Robert Kim
*Assistant Examiner*—Michael Maskell
(74) *Attorney, Agent, or Firm*—Stephen R. Burri

(57) ABSTRACT

An electron emitter for a display provides an electron source, an electron accelerator, an electron collector disposed between the electron source and the electron accelerator, and one or more electron deflectors to selectively deflect electrons in an electron beam or electron plane towards the electron collector phosphorous coating on a display screen, within a non-metallic vacuum chamber having an adjustable vacuum. Pinhead electrode electron deflectors may each control one color of a pixel, and each set of three adjacent pinhead electrodes may comprise a complete pixel on the display screen.

16 Claims, 10 Drawing Sheets

FIG. 8A
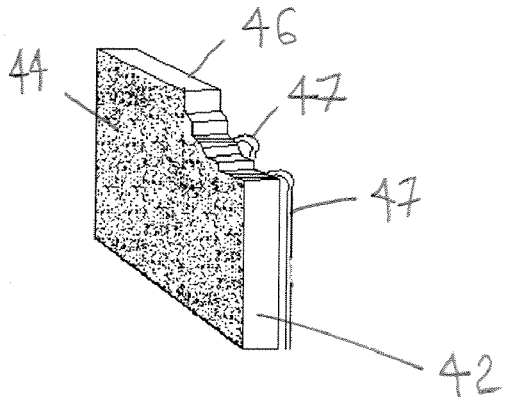
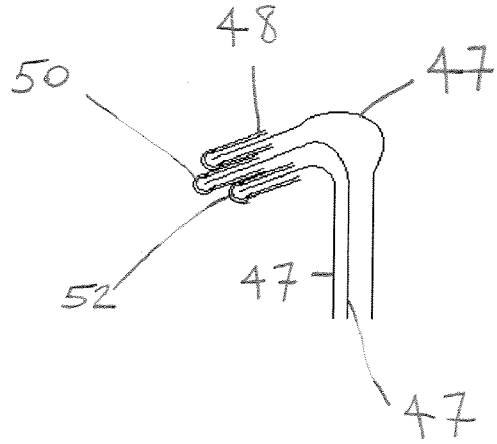
FIG 8B

COLD ELECTRON EMITTER DEVICE FOR DISPLAY

RELATED APPLICATION

This application is a continuation-in-part of U.S. non-provisional patent application Ser. No. 11/152,049 filed Jun. 15, 2005, Examiner Michael P. Maskell, Art Unit 2881.

TECHNICAL FIELD OF THE INVENTION

The present invention relates generally to electron emitters, and more particularly to a device for generating and collecting electrons emitted from a photocell exposed to light.

BACKGROUND OF THE INVENTION

Vacuum tubes are arrangements of electrodes in an envelope of glass or other material within which a vacuum has been applied. The electrodes are attached to leads passing through the envelope for connection to an electrical circuit. Simple vacuum tubes comprise a filament sealed in a glass envelope evacuated of all air. Upon heating of the filament by a process called thermionic emission, electrons are released form the filament. The released electrons, bearing a negative electrical charge, will move through the vacuum towards a positively-charged metal plate anode, resulting in a flow of electrons from the filament to the anode.

Vacuum tubes have been used for a wide variety of electronics applications, and are still used for specialised audio amplifiers. Vacuum tube principles are used in cathode ray tubes in televisions, oscilloscopes and computer monitors.

It is known to provide a device for x-ray imaging. An example of such a device includes U.S. patent application Ser. No. 10/795,414 by Kabushiki Kaisha Toshiba ("Toshiba"). The Toshiba patent describes an x-ray image tube device having a vacuum tube enclosing a main body. The main body has a photoelectric surface for converting light into electrons. Focusing electrodes along the length of the vacuum tube act as an electron accelerator and electron focuser directing electrons to an anode (electron collector) at the other end of the vacuum tube.

There are a number of desirable objectives in relation to electron emitters. Such electron emitters should ideally be able to operate without heating. They should be operable using a variety of electron activators, including various light sources. Existing electron emitters achieve some of these objectives, but with varying degrees of success.

SUMMARY OF THE INVENTION

In one of its aspects, the invention comprises an electron emitter device for a display, the device comprising an electron source plate adjacent a first edge of a display surface; an electron accelerator disposed adjacent an opposing second edge of the display surface, the accelerator having an adjustable accelerator potential difference applied thereto, an electron collector disposed parallel to and adjacent a first side of a linear path extending between the electron source and the electron accelerator; one or more electron deflectors disposed in a matrix on an electron directing plate extending parallel to and adjacent an opposed second side of the linear path extending between the electron source plate and the electron accelerator, each deflector having an adjustable deflector potential difference applied thereto; and a non-metallic vacuum chamber having an adjustable vacuum containing the electron source, the electron collector, the electron accelerator and the one or more electron deflectors.

Each electron deflector may be a pinhead electrode disposed towards the interior of the display surface and independently controllable by an electronic circuit, and may be adapted to control one pixel color. Each set of three adjacent pinhead electrodes may be adapted to control three distinct pixel colors.

In another embodiment, an electron emitter device for a display may comprise an electron source disposed in a first corner of the display surface; an electron accelerator disposed in an adjacent second corner of the display surface, the accelerator having an adjustable accelerator potential difference applied thereto, an electron collector disposed along the interior of the display surface; one or more electron deflectors disposed adjacent a linear path extending between the electron source and the electron accelerator, each deflector having an adjustable deflector potential difference applied thereto; and a non-metallic vacuum chamber having an adjustable vacuum containing the electron source, the electron collector, the electron accelerator and the one or more electron deflectors.

Each electron deflector may comprise a metal strip, and each strip may be connected to an electronic control circuit.

The electron source may be an electron gun. The electron source may be a photocell having a photosensitive side and the device may further comprise a light source positioned within the vacuum chamber to provide light of a wavelength selected to excite electrons on the photosensitive side of the photocell.

The light source may provide light in the visible spectrum, or infrared light. The light source may be a light emitting diode. The light source may be embedded within the photocell. The electron collector may further comprise a phosphorous coating on the interior of the display surface.

Other aspects of the invention will be appreciated by reference to the description of the preferred embodiment which follows and to the claims.

BRIEF DESCRIPTION OF THE DRAWINGS

The invention will be described by reference to the preferred embodiment and the drawings thereof in which:

FIG. 8A is a cutaway perspective view of an electron directing plate;

FIG. 8B is a schematic of the pinhead electrodes forming a pixel set;

DETAILED DESCRIPTION OF BEST MODE AND PREFERRED EMBODIMENT OF THE INVENTION

Figure 1:
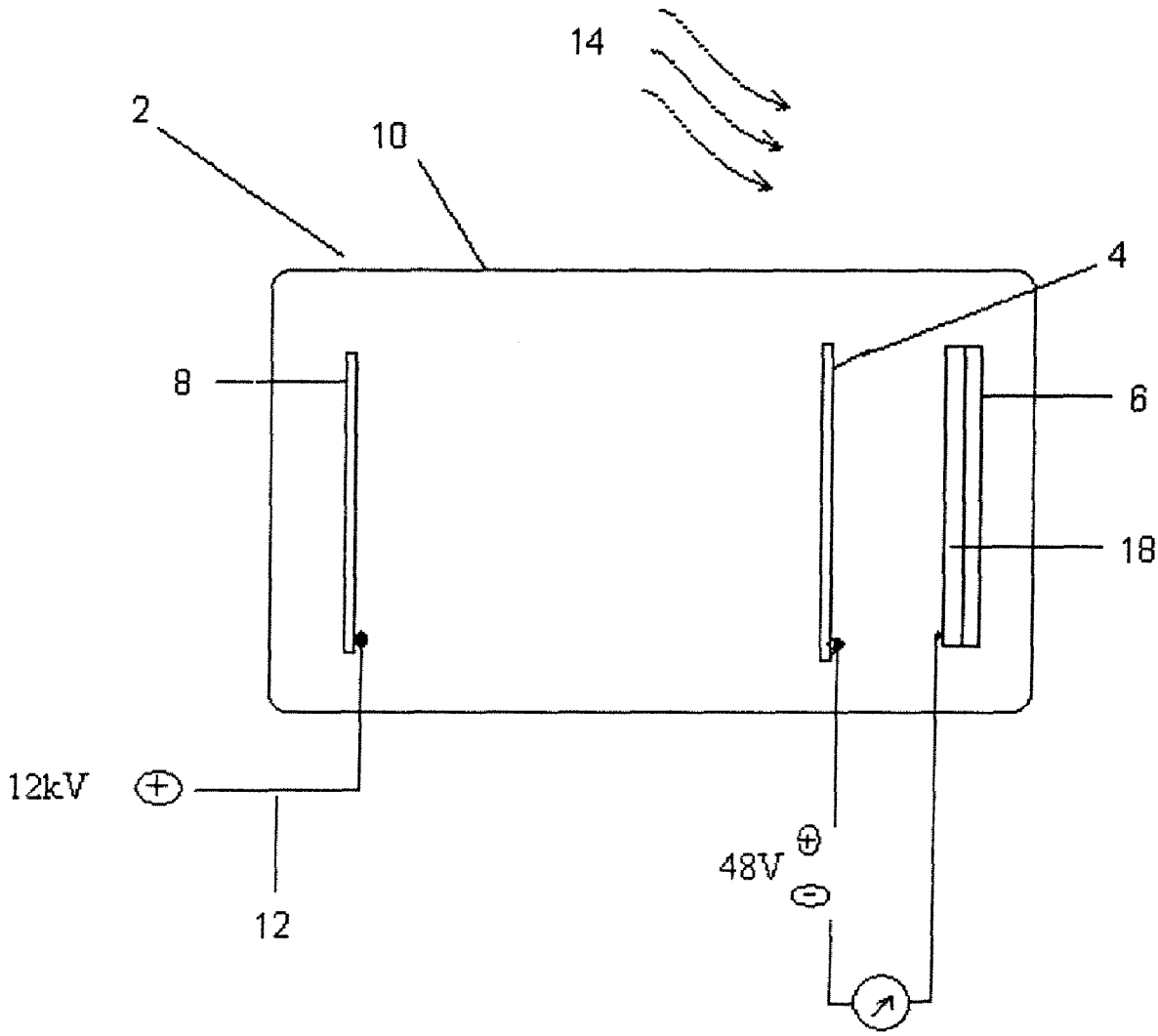
FIG. 1 is a schematic view of the electron emitter according to the invention.

As shown in FIG. 1, the cold electron emitter 2 according to the invention comprises a low-voltage metal plate electron collector 4 placed between a photocell 6 and a high-voltage metal plate electron accelerator 8, within a vacuum tube 10. A load 12 may be connected between the electron collector 4 and the photocell 6. In operation, light 14 from a light source such as a light emitting diode ("LED") strikes the photosensitive side 18 of the photocell, causing the emission of electrons from the surface of the photocell. With sufficient vacuum, the released electrons move in the direction of the electron accelerator 8 but are collected by the physically intervening electron collector 4.

In the preferred embodiment, a photocell comprising a semiconductor base sensitive to electromagnetic waves in the infrared range is contained within a vacuum tube. The light sensitive side of the photocell is connected to a negative voltage. A light source such as an infrared diode is positioned to face the light sensitive side of the photocell at an inclined angle, either inside the vacuum tube or outside of it. A first metal plate connected to a relatively high positive voltage is located within the vacuum enclosure a distance from and on the photosensitive side of the photocell and acts as an electron accelerator to attract electrons released from the photocell. Disposed between the first metal plate and the photocell within the vacuum tube is a second metal plate connected to a relatively low positive voltage, acting as an electron collector. An electronic circuit load may be connected between the photocell and the second metal plate.

Upon activation of the infrared source, infrared light is emitted which strikes the light sensitive side of the photocell, causing electrons to be excited and released from the photocell. The highly positively charged first metal plate electron accelerator will cause the released electrons to be accelerated toward it under sufficient vacuum conditions. Some of the electrons travelling towards the electron accelerator will encounter the second metal plate electron collector and be collected thereon.

In other embodiments, the device of the present invention may be used as a rectifier or regulator, able to replace vacuum tube in some of the applications where vacuum tubes are still in use, such as for audio amplifiers and high voltage devices. It may also have application as an x-ray generator, an electron microscope or a display screen.

With the use of tungsten as the metal of the electron collector, the device will function as an x-ray generator. Replacement of the electron collector metal plate with a glass plate to hold a specimen to be examined, will permit the technology to be used as an electron microscope. By replacing the electron collector metal plate with a glass plate coated in a phosphorous layer, the device may be used as a display screen for televisions and computer monitors.

The device may incorporate an electron multiplier between the electron collector and the photocell, which may comprise a micro-channel plate ("MCP"). An MCP is an array of tubes which amplifies electrons passing through tubes by secondary emission caused by released electrons striking the walls of the tubes and freeing additional electrons in a cascading pattern along the MCP.

Several experiments were carried out to determine the appropriate configuration of the present invention.

Experiment 1

Figure 2:
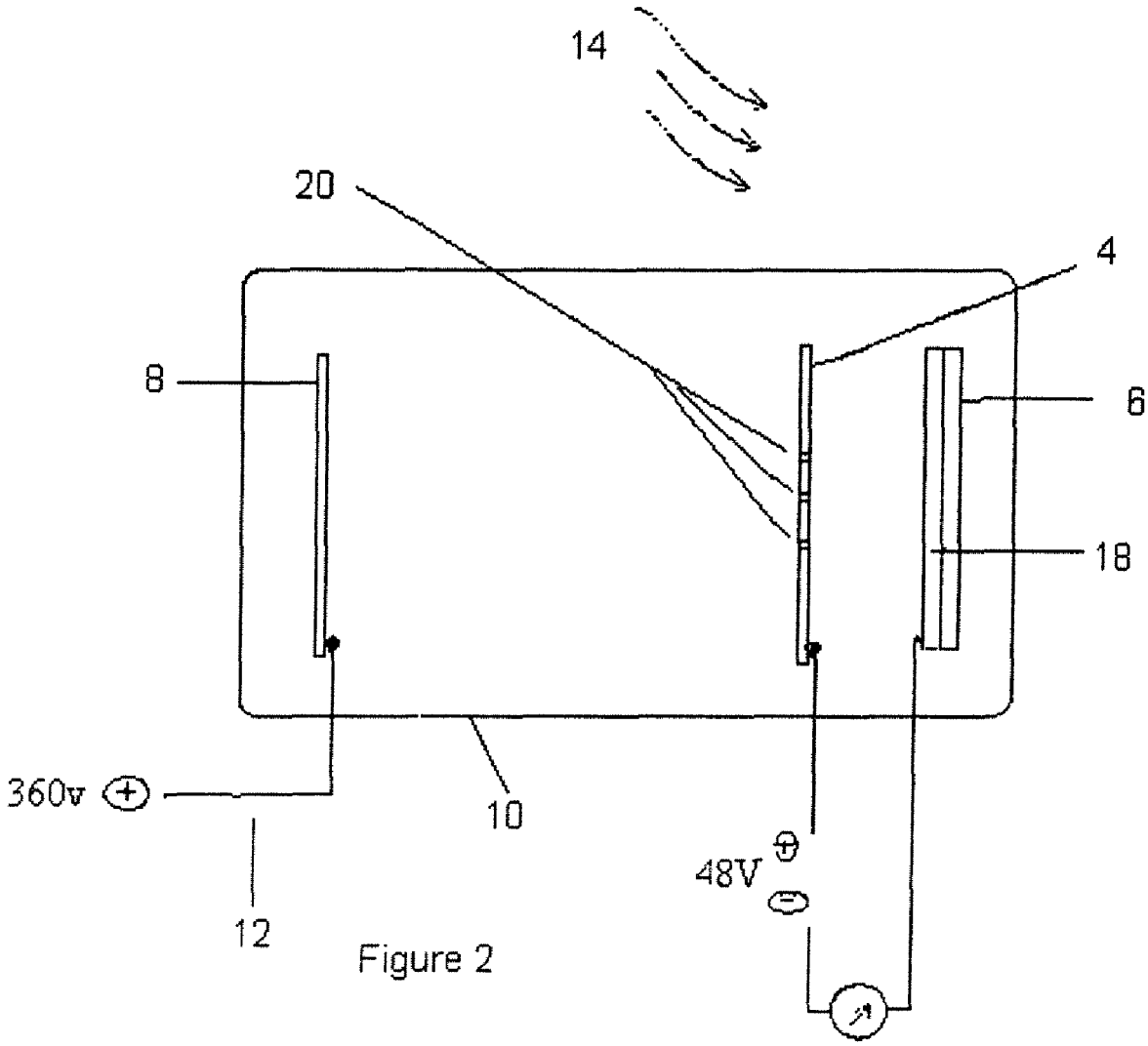
FIG. 2 is a schematic view of the electron emitter of Experiment 1.

As depicted in FIG. 2, a first prototype electron emitter device was assembled in the following configuration:

- the accelerator plate 8 was positioned a distance of approximately 3.0 cm from the collector plate 4;
- the accelerator plate 8 was positioned approximately 0.5 cm from the sides of the vacuum chamber 10;
- the collector plate 4 was positioned approximately 0.5 cm from the photocell 6;
- the collector plate 4 was provided with holes 20 therein to allow additional light to reach the photocell;
- the vacuum chamber is comprised of glass with a metallic lid; and
- the light 14 is provided by a light bulb operating with 2 AAA batteries, delivering 3 volts.

Under these conditions, no current was detected with a voltmeter connected between the photocell and the collector plate. Conclusions drawn that other vacuum and accelerating voltages may be required to produce current, and the holes in the electron collector may need to be removed.

Experiment 2

Figure 3:
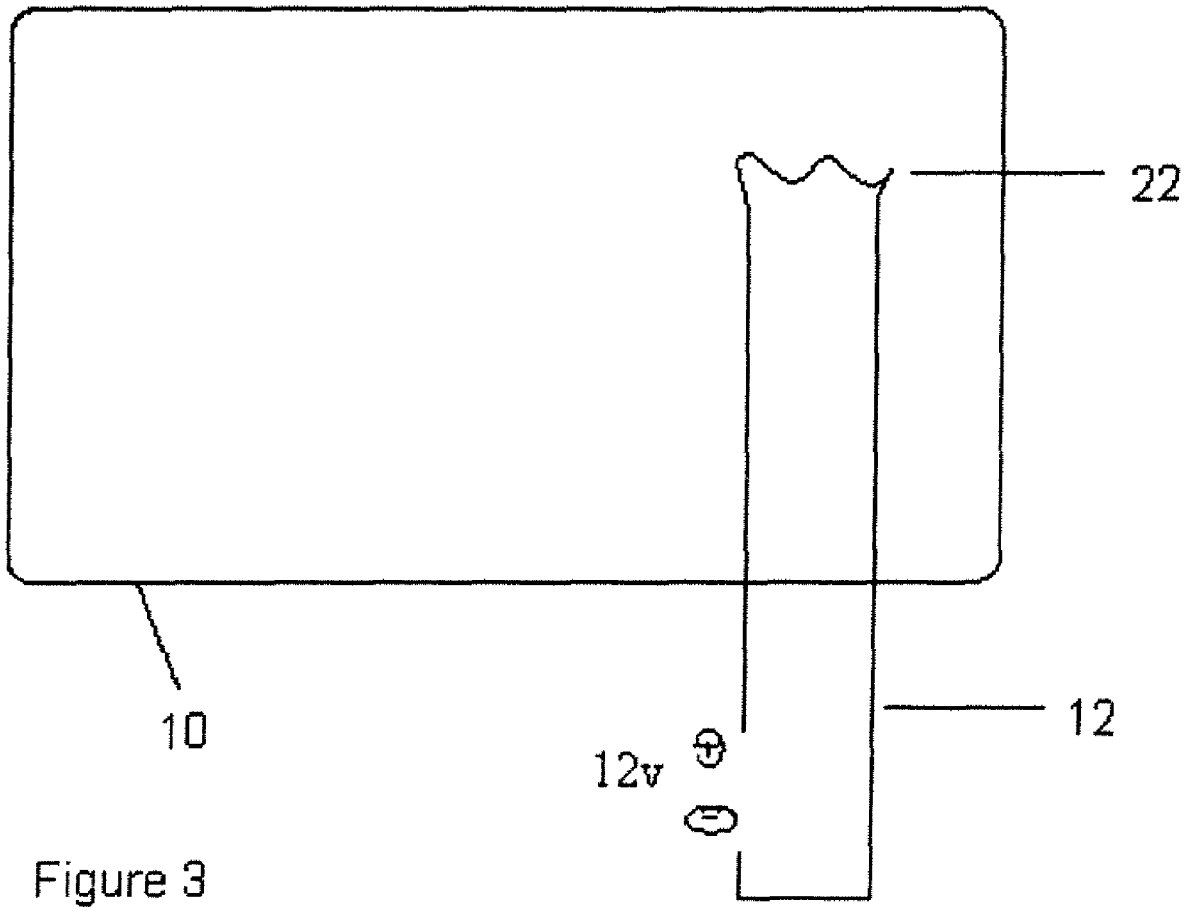
FIG. 3 is a schematic view of the electron emitter of Experiment 2.

As depicted in FIG. 3, the amount of vacuum required to produce a vacuum comparable to an automobile headlamp bulb was determined in the following configuration:

- a filament 22 from an automobile headlamp was connected to a 12 volt power source 12 within a vacuum chamber 10 having a vacuum of 15 inches HgV at a first setting and 23 inches HgV at a second setting.

Under these conditions, at a vacuum of 15 inches, the filament burnt out upon connection to the power source. At a vacuum of 23 inches, the filament burned brightly for 4 seconds, producing bright light and smoke. It was concluded that the prototype will require a higher vacuum than used in Experiment 1.

Experiment 3

The first prototype of Experiment 1 was connected to the vacuum tube socket of a vacuum tube radio. Under these conditions, no current was detectable with a voltmeter. It was concluded either that the accelerating voltage would need to be higher than that used with a standard vacuum tube or that the vacuum in the vacuum chamber was not sufficient relative to that of a standard vacuum tube.

Experiment 4

Figure 4:
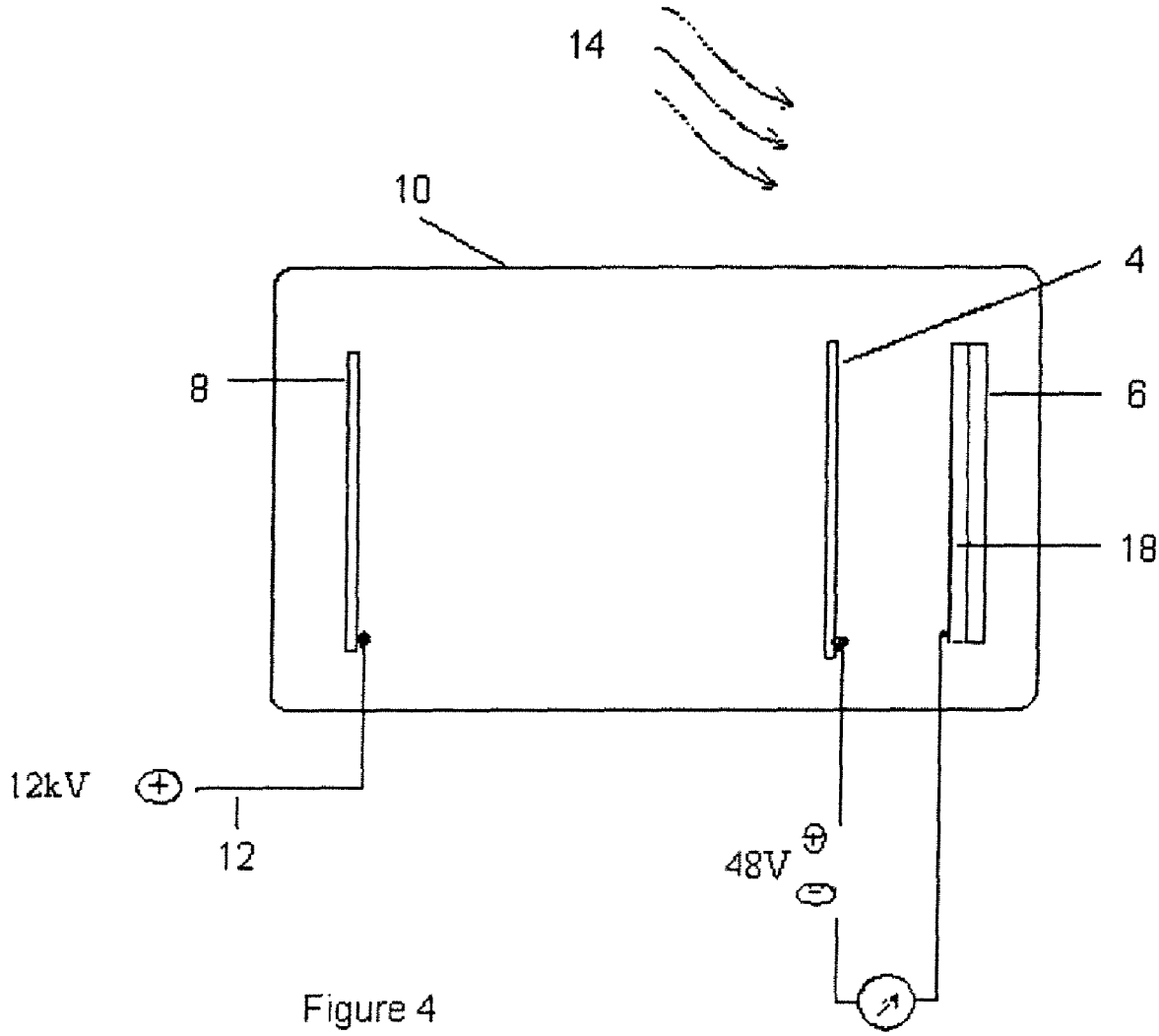
FIG. 4 is a schematic view of the electron emitter of Experiment 4.

As depicted in FIG. 4, a second prototype electron emitter device was assembled in the following configuration:

- the accelerator plate 8 was positioned a distance of approximately 3.0 cm from the collector plate 4;
- the accelerator plate 8 was positioned approximately 0.5 cm from the sides of the vacuum chamber 10;
- the collector plate 4 was positioned approximately 0.5 cm from the photocell 6;
- the vacuum chamber is comprised of glass with a metallic lid; and
- the light 14 is provided by a light bulb operating with 2 AAA batteries, delivering 3 volts.

Under these conditions, electric current was detected with a voltmeter connected between the photocell and the collector plate. The value of the electric current was dependant on the distance of the light source from the photocell. A current of 0.47 mA was produced with the light source approximately 4.0 cm from the photocell surface.

It was concluded that there was electrical leakage from the accelerator plate through the metallic lid of the vacuum chamber and the lid material should be non-conducting plastic. It was further concluded that the distance between the accelerator plate and the collector plate should be increased to avoid electric arching between the accelerator plate and the collector plate.

Experiment 5

Figure 5:
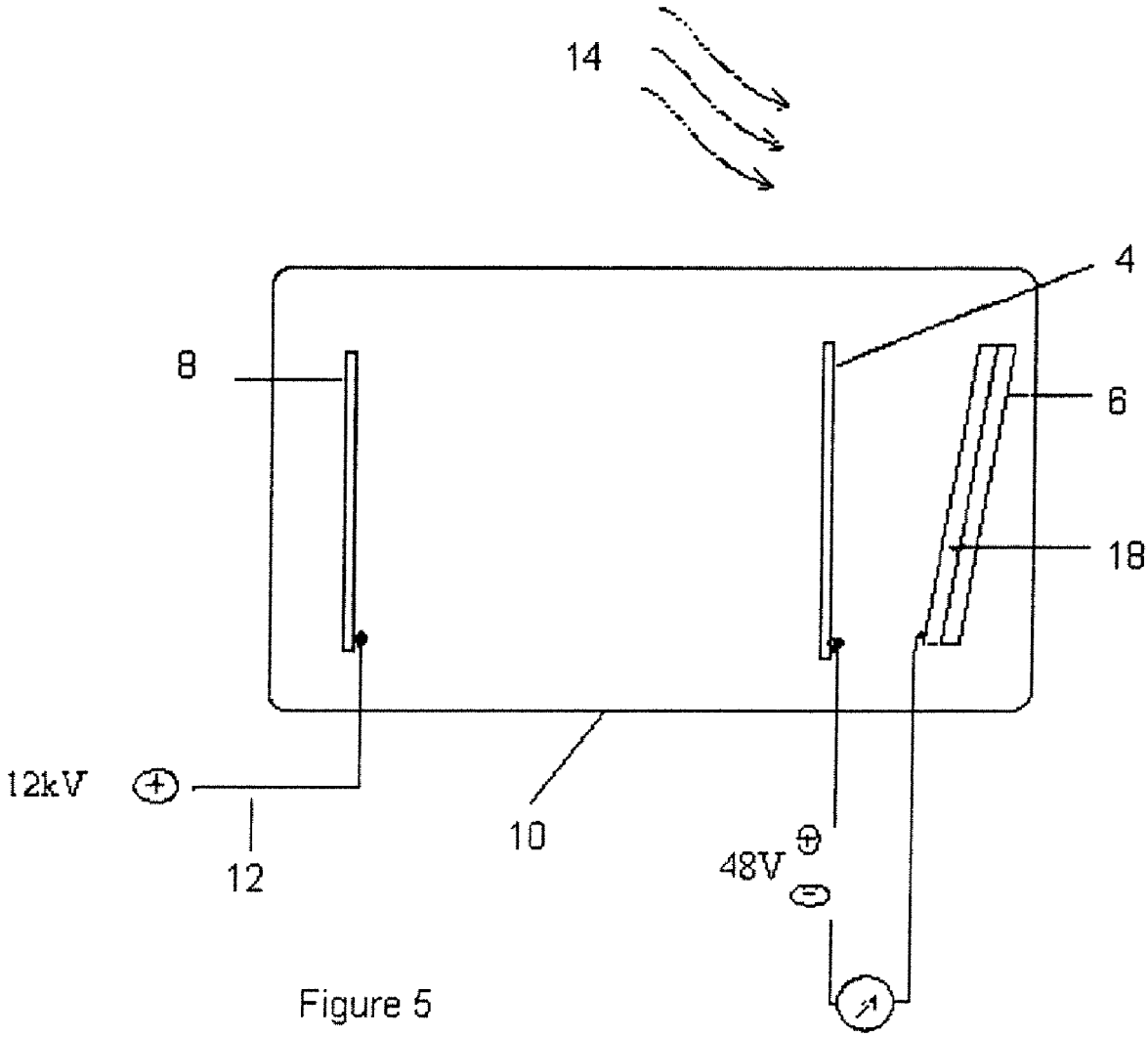
FIG. 5 is a schematic view of the electron emitter of Experiment 5.
Figure 6:
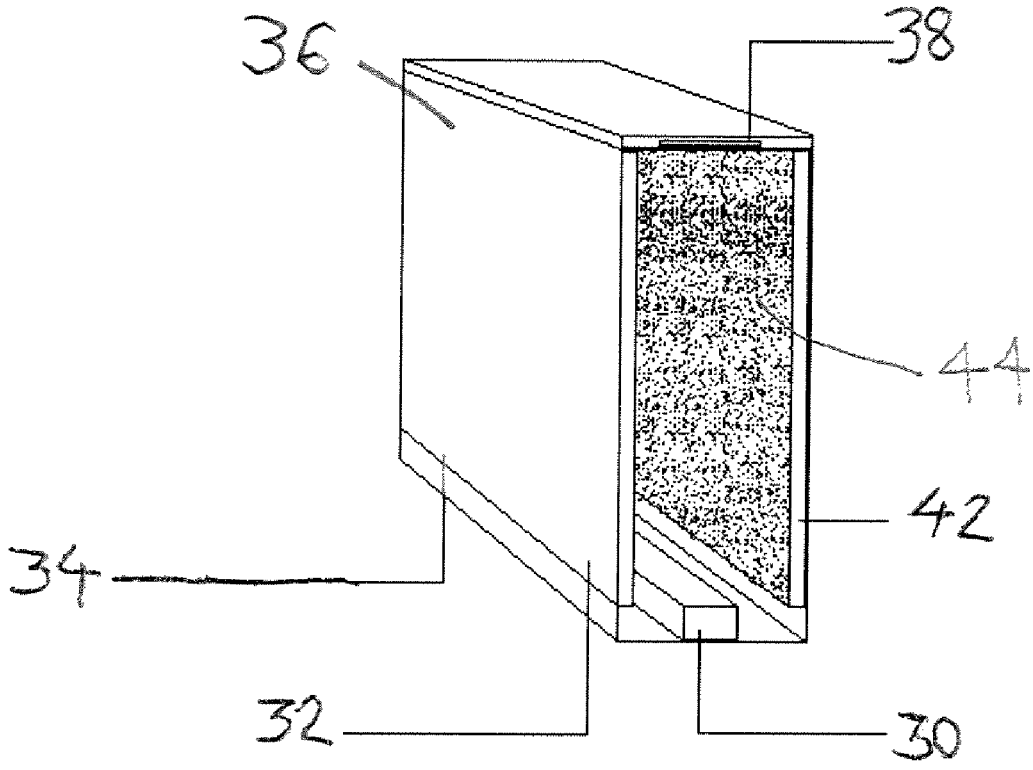
FIG. 6 is a perspective view of an embodiment of a display device.
Figure 7:
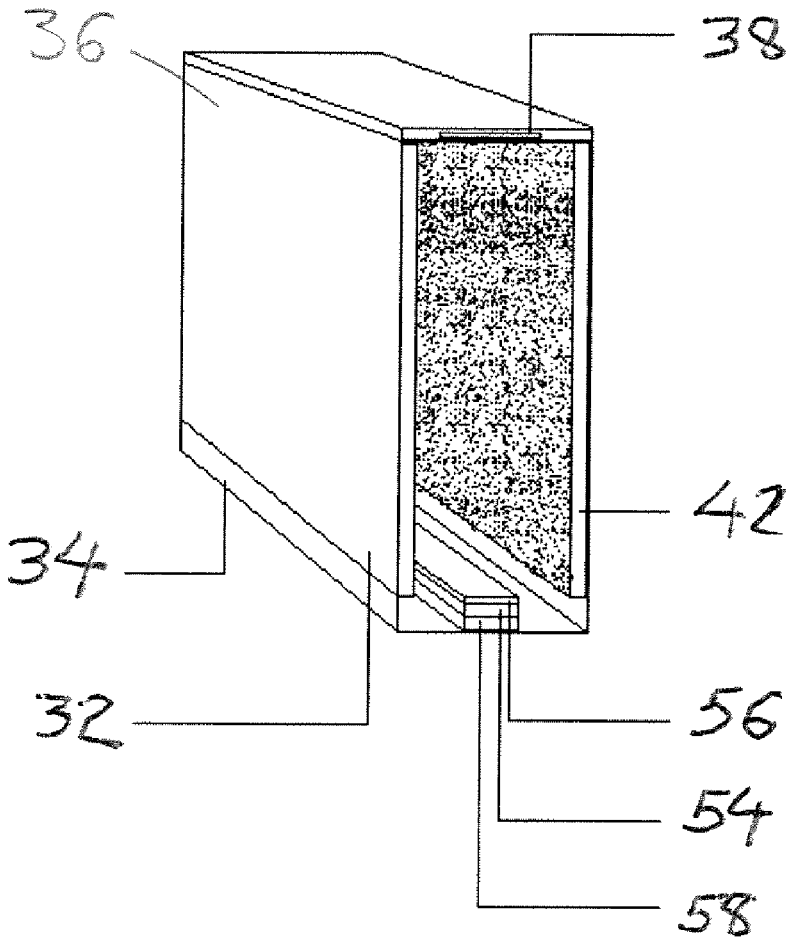
FIG. 7 is a perspective view of an embodiment of a display device

As depicted in FIG. 5, a third prototype electron emitter device was assembled in the following configuration:

- the accelerator plate was positioned a distance of approximately 6.0 cm from the collector plate 4;
- the accelerator plate 8 was positioned approximately 1.5 cm from the sides of the vacuum chamber 10;
- the collector plate 4 was positioned approximately 1.0 cm from the photocell 6;
- the dimensions of the collector plate were selected such that a line between any point on the photocell 6 and any point on the accelerator plate 8 would pass through the collector plate 4;
- the photocell was positioned at an incline relative to the collector plate to permit greater exposure to the incoming light from the light source;
- the vacuum chamber is comprised of glass with a plastic lid; and
- the light 14 is provided by a light bulb operating with 2 AAA batteries, delivering 3 volts.

Under these conditions, electric current was detected with a voltmeter connected between the photocell and the collector plate. The value of the electric current was dependant on the distance of the light source from the photocell. A current of 0.76 mA was produced with the light source approximately 2.0 cm from the photocell surface. A current of 0.47 mA was produced with the light source approximately 4.0 cm from the photocell surface. A current of 0.22 mA was produced with the light source approximately 8.0 cm from the photocell surface.

It was concluded that the electric current could be increased by using a more powerful light source which would produce more intense light at constant rates. As the light source was operating on battery power, the light produced become dimmer after some time of operation as the battery power was drawn down.

Several modifications of the device described are considered to be within the scope of the invention. For example, the light source may be positioned within the vacuum chamber or outside of it, provided the light is able to expose the photosensitive side of the photocell. The light source could be embedded within the photosensitive side of the photocell.

The light source may be a light emitting diode. The light could be of any colour of the visible spectrum, or infrared light, provided that the wavelength of light is selected to excite the electrons in the photocell.

With respect to the accelerator plate, the distance between the accelerator plate and collector plate could be reduced and the voltage connected to the accelerator plate lowered, provided that the vacuum in the vacuum chamber was correspondingly increased.

In the preferred embodiment, the space between the accelerator plate and collector plate comprises a vacuum. Alternatively, the accelerator plate and collector plate may be separated by a glass sheet. In such an embodiment, the accelerator plate may comprise a conductive transparent coating.

With respect to the collector plate, the voltage connected to the collector plate may be varied. The collector plate may be comprised of a material appropriate to the application used. For example, a collector plate comprising a phosphorous coating on glass could be used for a television display monitor. A tungsten plate may be used for production of x-rays. In another embodiment, the collector plate may comprise a specimen to be examined, as in an electron microscope.

The distance between the collector plate and the photocell may be reduced, provided this does not result in the collector plate preventing the light from the light source from reaching the photosensitive side of the photocell. The space between the collector plate and the photocell may be a vacuum, or it may be filled with an electron multiplier, such as a microchannel plate, to increase the electron output of the device.

In an alternative embodiment of the present invention, as depicted in FIGS. 6, 7, 8A and 8B, the electron emitter or electron source may be arranged in the shape of a plate 30 along one end of the display surface 32, for example, the bottom end, to emit electrons from many points of the plate. The resulting electron beams would comprise a plane of electrons, moving from one end 34 of the display surface to the opposing end 36. For example, the electron plane may move from the bottom end surface towards the top end surface, parallel to the display surface and driven by an electron accelerator anode 38, in an upward direction in this example. Parallel to the display surface, there may be provided a plate having a plurality of pinhead electrodes 40. This electron directing plate 42 may have the pinhead electrodes 40 arranged in a matrix form; whereby the pinhead electrodes are disposed on the phosphorous-facing side 44 of the electron directing plate facing the display surface, and the pinhead electrodes are connected from the side 46 away from the display surface to an electronic circuit 47 that drives each pinhead independently.

Each pinhead electrode may represent one pixel color. Each set of three adjacent pinhead electrodes (48, 50, 52) may represent a complete pixel. These 3-pinhead electrode sets may represent the red, green, and blue colors of a pixel. Once negatively charged, each one of these pinhead electrodes can be used to repel the electron beam, thereby enabling control of direction of these electrons towards a point on the phosphorous-facing side 44 of the display surface; one specific point for each pinhead electrode. As the electron beams in this case form an electron plane, all pinhead electrodes of one line (for example, a single row on the display screen) may be controlled simultaneously to display one line of the picture on the display surface. In this embodiment, an increase in electrons could be produced by increasing the width of the electron emitting plate.

Figure 9:
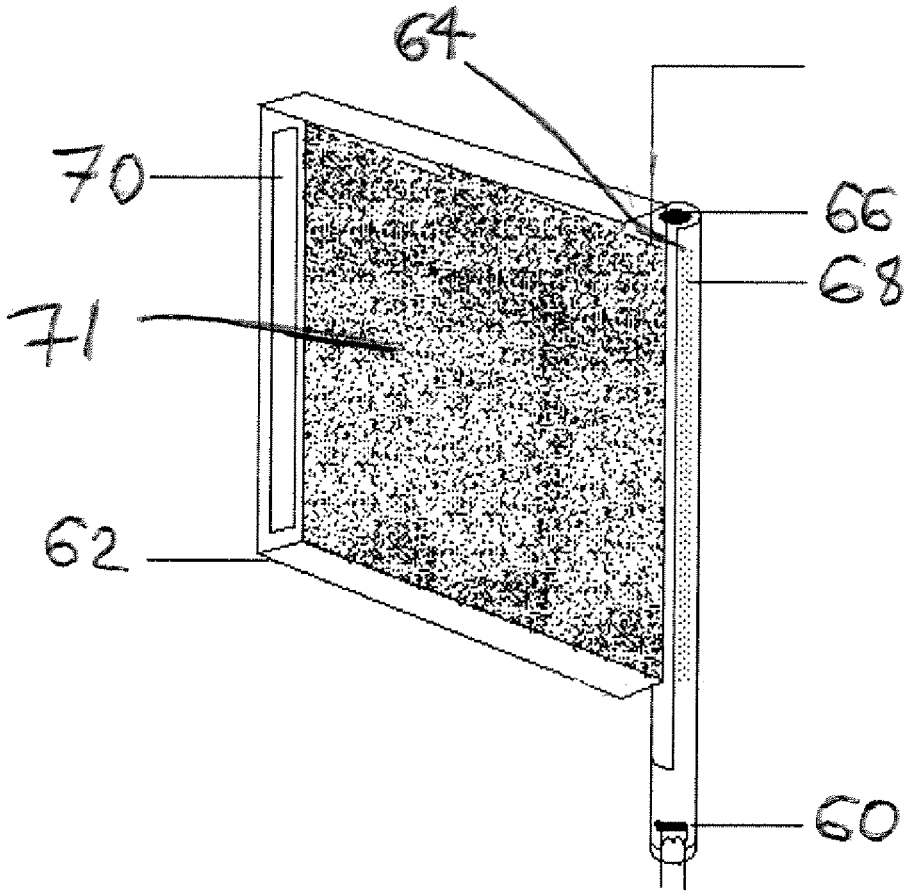
FIG. 9 is a perspective view of an embodiment of a display device.

In yet another alternative embodiment of the present invention, as depicted in FIG. 9, the electron source 60 may be placed near one corner of the display surface 62, for example, the bottom right corner, to emit an electron beam along the adjacent edge 64 of the display surface 62 to an adjacent corner. For example, the electron beam may move from the bottom right corner of the display to the top right corner. The electrons in such a beam may be accelerated using an electron accelerator 66 placed near an adjacent corner of the destination side of the electron source (for example, the top right side in this example). The electron beam may therefore represent the motion in the Y-axis.

Figure 10:
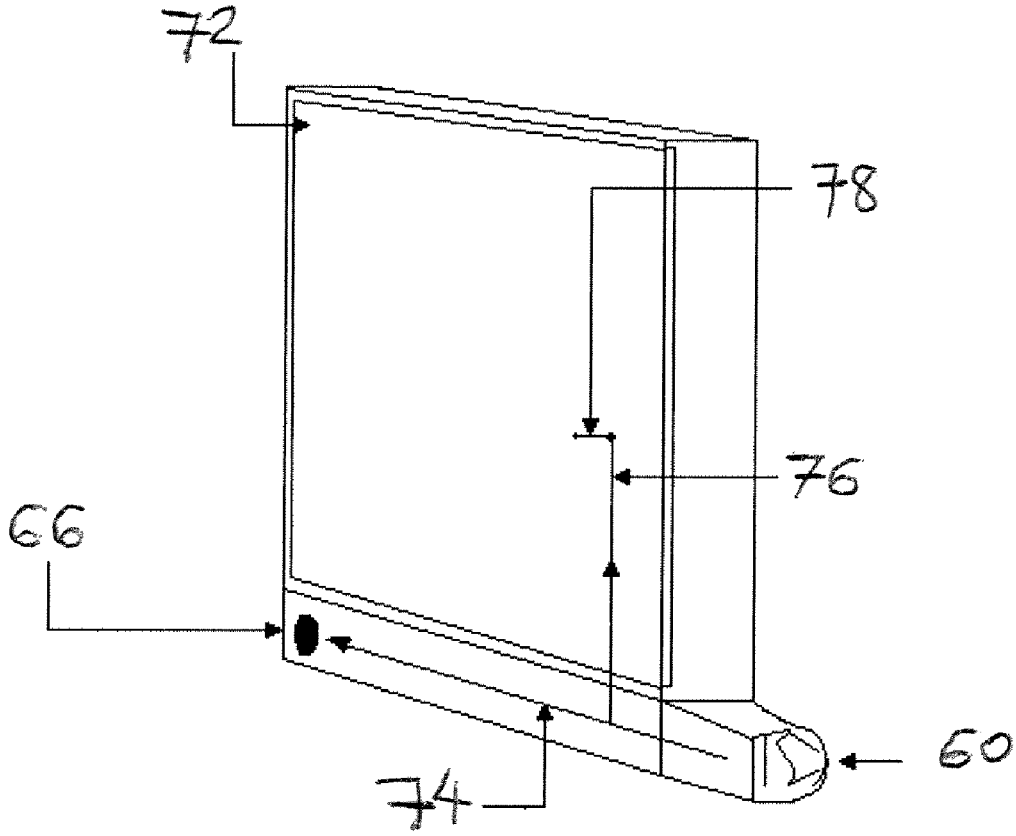
FIG. 10 is a perspective view of an embodiment of a display device.

The device may also have a differing orientation shown in FIG. 10, for example, with the electron source 60 at the lower right corner of the display surface and the electron accelerator 66 at the lower left corner, the initial electron beam 74 flowing along the bottom of the display (x-axis). This beam is deflected perpendicularly 76 along the height of the display (y-axis) by an electron deflector strip 68 and corresponding second electron accelerator 70, and further deflected 78 onto the phosphorous coating of the display screen (z-axis) by the pinhead electrodes in the electron deflector plate 71.

To direct these electrons along the display surface (the X-axis), there may be provided an electron deflector strip 68 alongside the electron beam (ex. along the right side in FIG. 9, from the bottom right corner to the top right corner), and an opposing metal plate or other second electron accelerator 70 that is positively charged to accelerate the electron beam deflected by the electron deflector. The electron deflector may comprise a plurality of small strips of metal plates (for example, metal strips of dimensions 2 mm×2 mm). Each such strip may be connected to an electronic circuit that controls the timing of activation of the strip. Once activated and negatively charged, each small strip may be used to direct a segment of the electron beam towards and parallel to lines or rows of the electron collector on the display surface; one line at a time. The (negatively-charged) pinhead electrodes of the electron deflector plate 71 may then be used to deflect the electron beam along the Z-axis towards the phosphorus side 72 of the display surface 62. As the electron beam is linear to these pinhead electrodes, each pinhead electrode may be individually activated.

In this embodiment, the electron source may comprise the cold electron emitter described herein, comprising a photosensitive cathode 54, a micro-channel plate 56 and a light emitting diode 58, or it may comprise an electron gun. With either electron source, the electron source is employed to produce a beam of electrons that excites a single pixel.

It will be appreciated by those skilled in the art that other variations of the preferred embodiment may also be practised without departing from the scope of the invention.

The invention claimed is:

1. An electron emitter device for a display, the device comprising:

an electron source plate adjacent a first edge of a display surface;

an electron accelerator disposed adjacent an opposing second edge of the display surface, the accelerator having an adjustable accelerator potential difference applied thereto, an electron collector disposed parallel to and adjacent a first side of a linear path extending between the electron source and the electron accelerator;

one or more electron deflectors disposed in a matrix on an electron directing plate extending parallel to and adjacent an opposed second side of the linear path extending between the electron source plate and the electron accelerator, each deflector having an adjustable deflector potential difference applied thereto; and a non-metallic vacuum chamber having an adjustable vacuum containing the electron source, the electron collector, the electron accelerator and the one or more electron deflectors wherein the electron source plate is a photocell having a photosensitive side and the device further comprises a light source positioned within the vacuum chamber to provide light of a wavelength selected to excite electrons on the photosensitive side of the photocell, wherein the light source is embedded within the photocell.

2. The device of claim 1, wherein each electron deflector is a pinhead electrode disposed towards the interior of the display surface and independently controllable by an electronic circuit.

3. The device of claim 2, wherein each pinhead electrode is adapted to control one pixel color.

4. The device of claim 3 wherein each set of three adjacent pinhead electrodes is adapted to control three distinct pixel colors.

5. The device of claim 1, wherein the electron source plate is an electron gun.

6. The device of claim 1 wherein the light source provides light in the visible spectrum.

7. The device of claim 1 wherein the light source provides infrared light.

8. The device of claim 1 wherein the light source is a light emitting diode.

9. The device of claim 1 wherein the electron collector further comprises a phosphorous coating on the interior of the display surface.

10. An electron emitter device for a display, the device comprising:

an electron source disposed in a first corner of the display surface;

an electron accelerator disposed in an adjacent second corner of the display surface, the accelerator having an adjustable accelerator potential difference applied thereto, an electron collector disposed along the interior of the display surface;

one or more electron deflectors disposed adjacent a linear path extending between the electron source and the electron accelerator, each deflector having an adjustable deflector potential difference applied thereto; and a non-metallic vacuum chamber having an adjustable vacuum containing the electron source, the electron collector, the electron accelerator and the one or more electron deflectors wherein the electron source plate is a photocell having a photosensitive side and the device further comprises a light source positioned within the vacuum chamber to provide light of a wavelength selected to excite electrons on the photosensitive side of the photocell, wherein the light source is embedded within the photocell.

11. The device of claim 10, wherein each electron deflector comprises a metal strip, each strip connected to an electronic control circuit.

12. The device of claim 10, wherein the electron source is an electron gun.

13. The electron emitter device of claim 10 wherein the light source provides light in the visible spectrum.

14. The electron emitter device of claim 10 wherein the light source provides infrared light.

15. The electron emitter device of claim 10 wherein the light source is a light emitting diode.

16. The electron emitter device of claim 10 wherein the electron collector further comprises a phosphorous coating on the interior of the display surface.

* * * * *